US006559629B1

(12) United States Patent
Fernald

(10) Patent No.: US 6,559,629 B1
(45) Date of Patent: May 6, 2003

(54) SUPPLY VOLTAGE MONITOR USING BANDGAP DEVICE WITHOUT FEEDBACK

(75) Inventor: Kenneth W. Fernald, Austin, TX (US)

(73) Assignee: Cygnal Integrated Products, Inc., Austin, TX (US)

( * ) Notice: Subject to any disclaimer, the term of this patent is extended or adjusted under 35 U.S.C. 154(b) by 0 days.

(21) Appl. No.: 09/901,851

(22) Filed: Jul. 9, 2001

(51) Int. Cl.[7] ..... G05F 3/16
(52) U.S. Cl. ..... 323/313
(58) Field of Search ..... 323/312, 313, 323/314, 315, 316

(56) References Cited

U.S. PATENT DOCUMENTS

| | | | | |
|---|---|---|---|---|
| 4,396,883 | A | 8/1983 | Holloway et al. | 323/313 |
| 5,367,249 | A | 11/1994 | Honnigford | 323/313 |
| 5,453,953 | A | 9/1995 | Dhong et al. | 365/189.09 |
| 5,530,398 | A | 6/1996 | Shamlou et al. | 327/545 |
| 5,596,265 | A | 1/1997 | Wrathall | 323/315 |
| 5,892,381 | A | 4/1999 | Koifman | 327/198 |
| 5,903,767 | A | 5/1999 | Little | 395/750.05 |
| 5,945,743 | A | 8/1999 | Pattantyus et al. | 307/10.1 |
| 5,955,873 | A | 9/1999 | Maccarrone et al. | 323/314 |
| 6,082,115 | A | 7/2000 | Strnad | 62/3.7 |
| 6,118,264 | A | 9/2000 | Capici | 323/316 |
| 6,400,212 | B1 * | 6/2002 | Sakurai | 327/539 |

OTHER PUBLICATIONS

Thomas H. Lee, The Design of CMS Radio–Frequency Integrated Circuits p. 736 of a text reference, undated, entitled "MOS Amplifier Design".

* cited by examiner

*Primary Examiner*—Adolf Deneke Berhane
(74) *Attorney, Agent, or Firm*—Howison, Thoma & Arnott, L.L.P.

(57) ABSTRACT

A voltage monitor having a bandgap reference circuit driven by a voltage to be monitored. The bandgap reference circuit produces a voltage and a second voltage that each vary with the voltage to be monitored. The magnitudes of these voltages are compared by an open loop comparator to provide a high speed output state. The output of the voltage monitor can be used to monitor a supply voltage and produce a reset signal to a processor if the supply voltage falls to a magnitude below a specified threshold.

21 Claims, 2 Drawing Sheets

50
60
58
56
54
52
92
94
eN
eN_b
100
90
66
72
74
80
76
88
64
68
70
82
78
86
62
84
96
98
102
RST
eN
eN_b
eN
eN_b
LOGIC
COARSE COMPARATOR
FINE COMPARATOR
BIAS
BANDGAP

SUPPLY VOLTAGE MONITOR USING BANDGAP DEVICE WITHOUT FEEDBACK

TECHNICAL FIELD OF THE INVENTION

This invention relates in general to circuits for monitoring the magnitude of voltages, and more particularly to bandgap reference circuits that do not utilize feedback amplifiers for driving the bandgap devices.

BACKGROUND OF THE INVENTION

Most electrical circuits require a supply voltage for powering the various components of the circuits. Supply voltages themselves are generally maintained within specified limits to assure proper operation of the circuits powered thereby. There are many types of regulator circuits that maintain the supply voltage within prescribed limits. In order to monitor the supply voltage and determine whether it is operating within its limits, a stable reference voltage is used for comparison with the supply voltage. In the event that the supply voltage is too far above the operating range, or too low, an output of the voltage monitor circuit can be used to deactivate the voltage supply itself, or disable the powered circuits so that unreliable circuit operation does not occur.

Voltage monitor circuits are especially useful in processor controlled circuits so that if the supply voltage becomes too low, the processor can be disabled or maintained in a reset condition so that improper processor operation does not occur. In this way, the processor will not process instructions with circuits of the processor operating in an unreliable condition, due to inadequate supply voltages.

There are many other electrical circuits that require a reference voltage in order to compare a stable voltage with an unknown voltage. A reference voltage is a necessary circuit in many analog voltage circuits, such as A/D and D/A converters. Analog comparators in general employ a reference voltage on one input thereof, and the unknown voltage on the other input. The state of the comparator output is an indication of whether the unknown voltage is above or below the known reference voltage.

Circuit designers have typically relied on bandgap circuits to generate precision reference voltages that are stable and highly independent of temperature. The bandgap voltage of a semiconductor junction is utilized in many reference voltage circuits to produce a stable and known voltage. It is well known that the bandgap voltage of a silicon pn junction is about 1.21 volts.

One bandgap reference voltage circuit that is of a typical design is shown in FIG. 1. Here, the voltage reference 10 employs a first diode 12 having a defined pn junction area, and a second diode 14 having a larger area pn junction. There is a resistor 16 that is connected in series with the first diode 12, and a pair of resistors 18 and 20 connected in series with the second diode 14. The resistors 16 and 18 are matched in value. Junction 22 between the first diode 12 and the resistor 16 is coupled to the noninverting input of a feedback amplifier 26. The junction 24 between resistors 18 and 20 is connected to the inverting input of the feedback amplifier 26. The output 28 of the feedback amplifier 26 produces a voltage for driving the equal-value resistors 16 and 18. In order for the feedback amplifier 26 to operate in a state of equilibrium, the voltage at the node 24 must be substantially equal to the voltage of node 22. The values of resistors 16, 18 and 20 are chosen such that when operating at equilibrium, the output voltage of the circuit 10 is substantially equal to a temperature compensated bandgap voltage of the diodes 12 and 14, which is about 1.25 volts. This reference output voltage is very stable and highly independent of temperature variations.

When the feedback amplifier 26 is operating in a state of equilibrium, the junction voltages of the diodes 12 and 14 are somewhat different, due to the difference injunction area. The difference in the junction voltages is reflected across the resistor 20. When the voltages at nodes 22 and 24 are substantially equal, the output 28 of the feedback amplifier 26 is ideally the temperature compensated bandgap voltage of about 1.25 volt.

When utilized to monitor a supply voltage, the reference voltage Vref at the output 28 of the circuit 10 can be coupled to the noninverting input of a comparator 30. The supply voltage (Vdd) is connected to a resistor divider which includes resistors 32 and 34. The node 36 between resistors 32 and 34 is coupled to the inverting input of the comparator 30. The voltage of the node 36 is the threshold voltage which establishes the lower limit of the supply voltage. When the supply voltage is reduced in magnitude, for whatever reason, the threshold voltage at node 36 of the divider will be lowered in an amount proportional to the values of the resistors 32 and 34. If the voltage at node 36 goes below the reference voltage Vref, then the output of the comparator 30 will be driven to a high state. The output of the comparator 30 can be used as a reset signal to a processor to prevent operation thereof when the supply voltage is below a prescribed magnitude. In the event that the supply voltage returns to an acceptable magnitude, the output of the comparator 30 will switch to the other state and allow the processor to resume processing instructions.

While the reference voltage circuit 10 of FIG. 1 is adequate for many applications, there are several disadvantages when employed with processor and other circuits. For example, the use of an amplifier 26 requires additional current from the supply voltage, and the feedback configuration exhibits a second order (or higher) transient behavior, which increases the settling time in order for the circuit output to become stable. Hence, a period of time must elapse before the powered circuits can become operational. This is especially important in processor operations, where additional measures must be taken into account before the processor can start executing instructions in a reliable manner. Another disadvantage to the bandgap reference circuit 10 is that when monitoring a supply voltage, the feedback amplifier 26 cannot often function when the supply voltage is low.

From the foregoing, it can be seen that need exists for a bandgap circuit configuration that is fast reacting, requires less power supply current, and can operate at low supply voltages. A need exists for a voltage monitor circuit that is well adapted for use with reset circuits of processors.

SUMMARY OF THE INVENTION

The present invention disclosed and claimed herein, in one aspect thereof comprises a bandgap voltage reference circuit coupled to a comparator. The comparator does not provide feedback for powering the bandgap circuit, thereby improving the response time of the reference voltage circuit. Rather, the bandgap circuit is driven directly by the supply voltage which, when the voltage thereof falls below a threshold, or rises above the threshold, the output of the comparator changes in a corresponding manner. By using a comparator rather than a feedback amplifier coupled to the bandgap circuit, the voltage monitor circuit can function in a high speed manner with lower supply voltages.

Voltages other than supply voltages can be monitored by simply driving the bandgap circuit of the invention with such voltage.

In accordance with other aspects of the invention, the resistors of the bandgap reference circuit can be fabricated in the semiconductor material, using shared resistors associated with both of the diodes of the bandgap reference circuit. Also, some of the semiconductor resistors can be fabricated as two separate resistors, thereby allowing more precise resistor values.

In accordance with yet another feature of the invention, the comparator circuit can be designed as a fine comparator that is highly sensitive, and a coarse comparator that continues to function at low voltages when the fine comparator would not otherwise be able to function properly.

Another feature of the invention includes circuitry that can enable and disable the bandgap reference circuit. The enable/disable circuitry can disable the bandgap circuit and drive the output of the comparator circuit to a predefined state. This feature is useful in processor circuits where, if the supply voltage is too low and would otherwise keep the processor in a reset state, the output state of the bandgap reference circuit can be driven to a state that allows the processor to operate, if possible, with the low supply voltage.

BRIEF DESCRIPTION OF THE DRAWINGS

Further features and advantages will become apparent from the following and more particular description of the preferred and other embodiments of the invention, as illustrated in the accompanying drawings in which like reference character generally refer to the same parts or elements throughout the views, and in which.

DETAILED DESCRIPTION OF THE INVENTION

Figure 2:
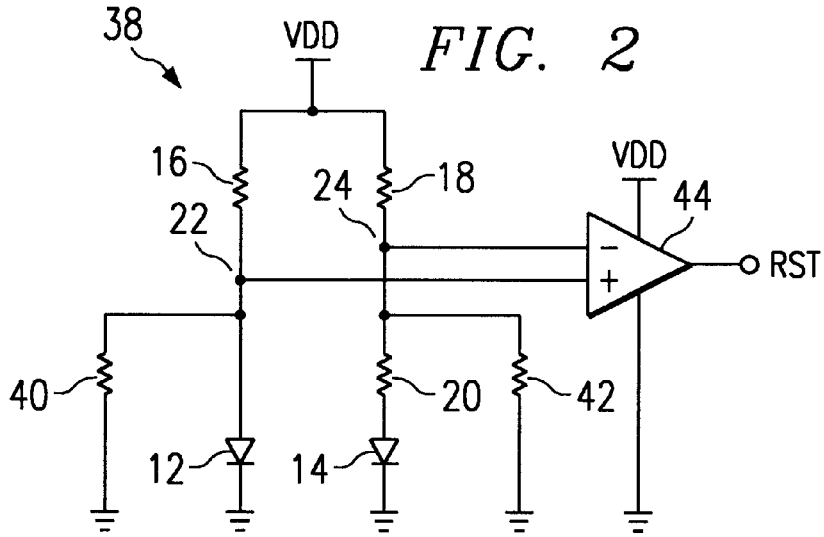
FIG. 2 illustrates a supply voltage monitor employing the principles and concepts of the invention.

With reference now to FIG. 2, there is shown a bandgap reference 38 that embodies some of the features of the invention. The bandgap circuit 38 includes a resistor 16 connected to a first pn junction embodied as a forward-biased diode 12. The circuit 38 also includes first and second series-connected resistors 18 and 20 connected to a second pn junction embodied as a second forward-biased diode 14. According to conventional bandgap reference circuits, the pn junction of the second diode 14 has a junction area that is larger than the area of the pn junction of the first diode 12. The pn junctions can also be formed as mos or bipolar transistors connected so as to function as diodes.

Figure 1:
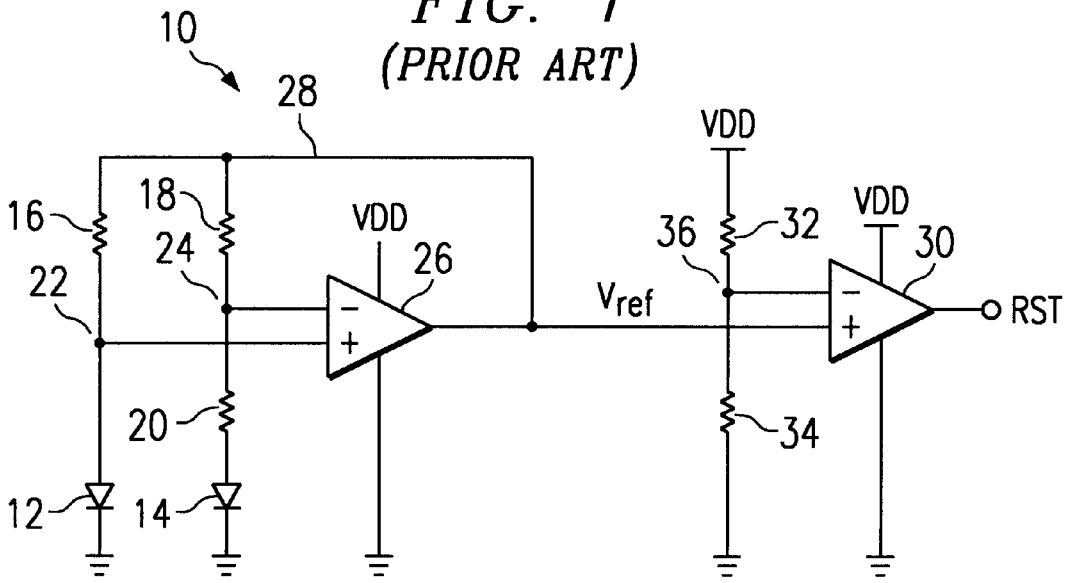
FIG. 1 (PRIOR ART)
FIG. 1 illustrates a supply voltage monitor constructed according to the prior art.

The bandgap circuit 38 is connected to a comparator 44, rather than to a feedback amplifier 26 as shown in FIG. 1. The inverting input of the comparator 44 is connected to the resistor divider node 24 to sense changes in the voltage to be monitored. As the supply voltage increases or decreases, the voltage at node 24 increases and decreases in a manner determined-by the values of the various resistors. The non-inverting input of the comparator 44 is connected to node 22. The voltage at node 22 also increases and decreases with corresponding changes in the supply voltage. Although the voltage at both nodes 22 and 24 changes with variations in the supply voltage, the voltage changes are not equal for the same change in the supply voltage. The inequality of the voltage changes at nodes 22 and 24 is due to the difference in the current/voltage characteristics of the different-size diodes 12 and 14, and the value resistor 20. The voltage at nodes 22 and 24 is ideally equal when the reference circuit 38 is functioning according to the principles of bandgap operation. Unlike the conventional reference circuit of FIG. 1 where the output of the feedback amplifier 26 produces the temperature compensated bandgap voltage, the reference circuit 38 of the preferred embodiment does not produce the temperature compensated bandgap voltage at any node or output thereof. Rather, the output of the reference circuit 38 produces a logic state output.

One terminal of each of the resistors 16 and 18 is connected to the voltage to be monitored. If the supply voltage is being monitored, then the supply voltage (Vdd) is connected to the resistors 16 and 18 as shown. For any voltage being monitored by the reference circuit 38, the voltage at nodes 22 and 24 will vary with variations in the monitored voltage. However, when the voltage being monitored crosses the temperature compensated bandgap voltage of about 1.25 volts, the output of the comparator 44 will change. The state of the output of the comparator 44 indicates whether the voltage being monitored is greater are less than the reference bandgap voltage. The function of optional scaling resistors 40 and 42 will be described below.

The bandgap circuit 38 voltage is highly independent of the temperature of the circuit, and independent of the processing variations inherent in the fabrication of the pn junctions. The value of resistor 18 is made to exactly match that of resistor 16. Because both resistors 16 and 18 are coupled to the same voltage, namely Vdd in the example, the bandgap circuit 38 integrated with the comparator 44 is utilized to provide an output logic state, rather than having to use a feedback amplifier 26 with the bandgap circuit 10, in addition to a separate comparator 30 and resistor divider, as shown in FIG. 1.

Because there is no amplifier feedback involved in the bandgap reference of FIG. 2, the settling time of the comparator output is much improved. Also, comparators can be designed to operate reliably at low supply voltages. It can be appreciated that when the voltage to be monitored is the supply voltage, it is this voltage that also powers the comparator 44. Hence, when the supply voltage falls to a low value, it is desirable that the comparator remain functional in performing the comparing function. Since comparators can be designed to operate at low supply voltages, the voltage monitor of the invention can operate at supply voltages lower than comparable reference voltage circuits using feedback amplifiers. Lastly, since the bandgap reference of FIG. 2 requires fewer active components, such circuit can function on less power than the reference circuit of FIG. 1, is more reliable, and less costly since it has fewer components.

In the event that one desires to compare the voltage to be monitored with a voltage other than the 1.25 volt temperature compensated bandgap voltage, then the scaling resistors 40 and 42 can be bridged across the respective diodes 12 and 14. Preferable, the resistance of resistor 40 is the same as that of resistor 42. With this configuration, the reference voltage can be varied so as to be greater than 1.25 volts. Those skilled in the art can readily determine the resistance of resistors 40 and 42 that is necessary to achieve a desired reference voltage. More particularly, the ratio of resistor 16 and scaling resistor 40 (and the ratio of resistor 18 and scaling resistor 42) determines the extent that the voltage to be monitored is scaled upwardly. Other scaling circuits can be devised by those skilled in the art to achieve a reference voltage less than the bandgap voltage.

The output of the comparator 44 can be used as a reset signal (RST) for controlling the operation of a processor, microcontroller, microprocessor or other programmed circuit. If the supply voltage has a magnitude greater than the bandgap reference voltage, then the RST output of the comparator 44 is low and the processor is not forced into a reset condition. If, on the other hand, the supply voltage becomes lower than the bandgap reference voltage, then the output of the comparator 44 is driven to a high state, thereby forcing the processor to a reset state. In the event that the supply voltage returns to the proper magnitude, then the comparator output returns to the low state without second order transients, and allows the processor to resume operations in a fast and reliable manner.

While the bandgap reference described in connection with FIG. 2 is shown monitoring a supply voltage, it should be appreciated that any other voltage can be monitored as well. In addition, the output of the comparator 44 can control many other types of circuits, other than processors.

Figure 3:
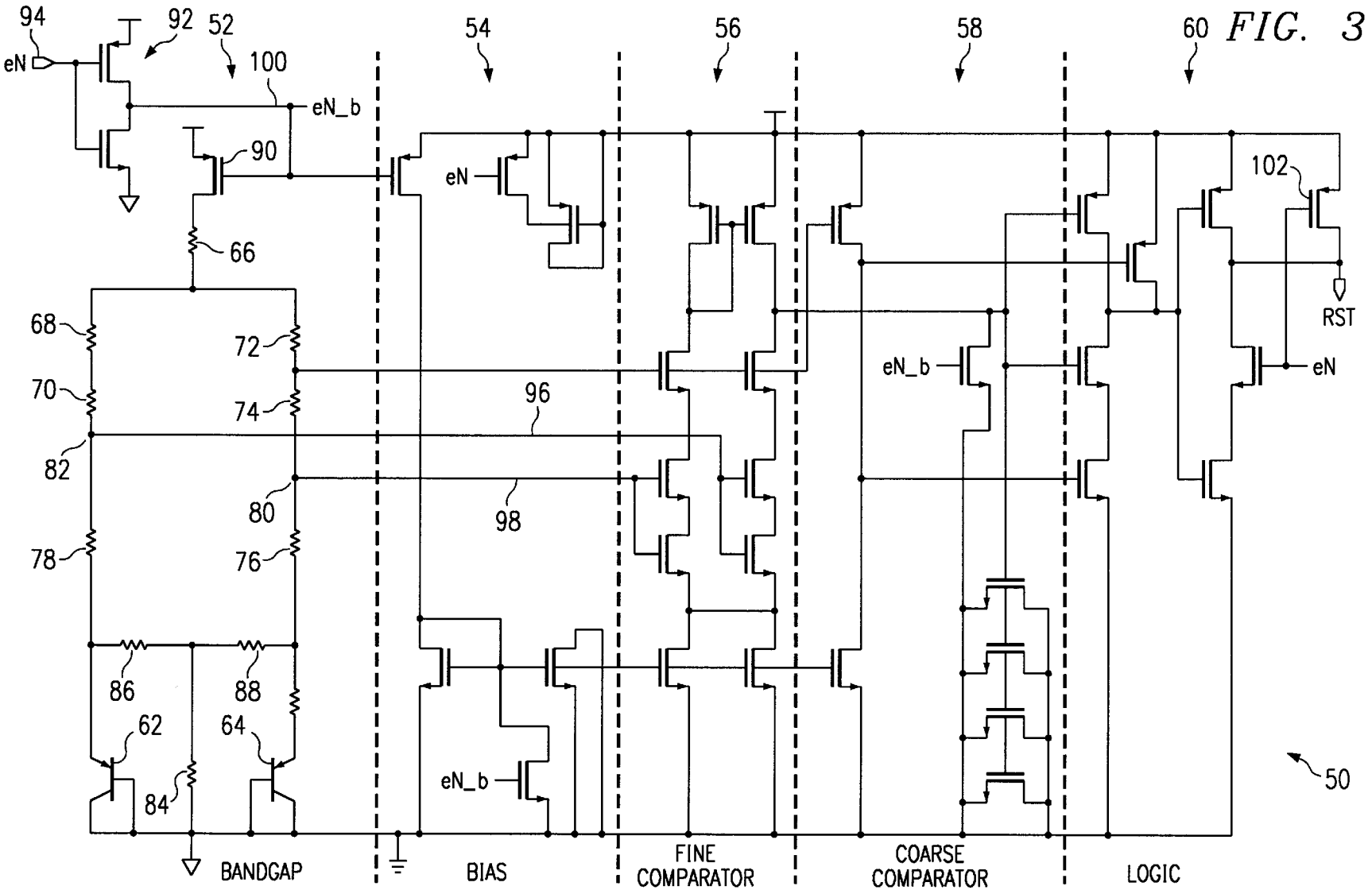
FIG. 3 illustrates a detailed diagram of a supply voltage monitor constructed according to a preferred embodiment.

Reference is now made to FIG. 3 where there is shown a detailed drawing illustrating a supply voltage monitor 50 constructed according to another embodiment of the invention. Here, the supply voltage monitor 50 includes a bandgap reference circuit 52, a bias circuit 54, a fine comparator 56, a coarse comparator 58, and a logic output circuit 60.

The bandgap reference circuit 52 includes a first bipolar transistor 62 that is connected as a diode. In like manner, also included is a second bipolar transistor 64 connected as a diode. The semiconductor resistors connected to the respective diodes 62 and 64 are formed as plural individual resistors to facilitate the fabrication of precision resistors in the semiconductor material. It is well known that a single large-value resistor is more difficult to make, as compared to plural smaller resistors connected together to achieve the same value. Accordingly, resistors 66, 68 and 70 correspond to resistor 16 of FIG. 2. Resistors 66, 72 and 74 correspond to resistor 18 of FIG. 2. It is noted that resistor 66 is common to the resistance in the branch driving diode 62, and to the resistance in the branch driving diode 64.

By using a common resistor 66, the number and area required for the resistors is minimized. The resistors 68 and 70 are fabricated as two individual resistors connected in series to achieve a more predictable resistance, as compared to fabricating a single larger resistor. Resistors 72 an 74 are fabricated as two resistors for the same reasons as resistors 68 and 70. Resistor 76 functions to shift the level of the voltage at node 80 to assure a suitable voltage range for driving the n-channel transistors of the fine comparator 56. The resistor 78 corresponds to the resistor 76 and provides a similar level shifting function for the voltage provided at node 82.

Resistors 84 and 86 are scaling resistors that correspond to the resistor 40 of FIG. 2. Resistors 84 and 88 are scaling resistors that correspond to resistor 42 of FIG. 2. The resistor 84 is shared with resistors 86 and 88 for the same purpose as shared resistor 66 described above.

The supply voltage monitor 50 of FIG. 3 functions to monitor a supply voltage of an integrated circuit on which a microprocessor is fabricated. To that end, the bandgap reference circuit 52 is connected to a Vdd supply voltage through an enable circuit 90. The enable circuit 90 includes a p-channel transistor connected between the supply voltage and the shared resistor 66. The gate of the enable transistor 90 is driven by a driver 92. When an enable signal of a high state is coupled to the enable terminal 94, the driver 92 places a logic low on the gate of the enable transistor 90 and allows the bandgap reference circuit 52 to operate. When the enable signal on input 94 is driven to a logic low, the enable transistor 90 is driven into a nonconductive state, thereby disabling the bandgap reference circuit 52.

The bias circuit 54 provides the necessary bias voltages for the fine comparator 56. The fine comparator 56 has a noninverting input 96 for sensing the bandgap reference voltage at node 82 of the bandgap reference circuit 52. The fine comparator 56 has an inverting input 98 for sensing the voltage to be monitored at node 80. The fine comparator 56 is designed to be highly sensitive to the differences between the voltages to be compared. To that end, the fine comparator 56 operates at low supply voltages, but when the supply voltage drops too low, the fine comparator 56 ceases to function. In this situation, the coarse comparator 58 resumes operation to carry out the comparison, albeit in a less sensitive manner. The coarse comparator 58 functions in a single-ended manner to provide logic output states corresponding to the results of the comparison.

The logic circuit 60 is adapted to provide a logic output of a desired state when the bandgap reference circuit is disabled. Indeed, the bandgap reference circuit 52 can be disabled by driving the enable signal on input 94 low. This drives the en_b signal on line 100 to a logic high, which turns off the enable transistor 90, thereby disconnecting the supply voltage from the bandgap reference circuit 52. The logic low on the enable input 94 is also coupled to transistor 102 of the logic circuit 60. When driven to a logic low, transistor 102 conducts and drives the RST signal output of the bandgap reference 50 to a logic high. This logic state of the RST signal indicates to the processor, or to other circuits, that the supply voltage is within prescribed limits, when indeed the opposite may be the case. Thus, when a supply voltage that is too low to permit proper operation of the processor, the processor can nevertheless be allowed to continue operation by asserting the enable signal on input 94 to a low state.

In view of the foregoing, a precision supply voltage monitor has been disclosed, which is a more efficient circuit in terms of speed of operation, fewer components, and operates at a lower power supply voltage.

Although the preferred and other embodiments have been described in detail, it should be understood that various changes, substitutions and alterations can be made therein without departing from the spirit and scope of the invention, as defined by the appended claims. For example, two voltage monitor circuits can be used to determine whether a voltage is within a given range. Also, the voltage monitor circuit can be configured to determine if a voltage is above a given threshold. As can be appreciated, the voltage monitor of the invention can be utilized in many applications.

What is claimed is:

1. A voltage monitor circuit, comprising:

an open loop bandgap detection circuit having first and second pn junctions, said open loop bandgap detection circuit driven by a voltage to be monitored;

a first node associated with said first pn junction for providing a first voltage and driven by said open loop bandgap detection circuit, which said first voltage varies as a function of the voltage to be monitored at a first rate;

a second node associated with a second pn junction that provides a second voltage and driven by said open loop bandgap detection circuit, which said second voltage varies as a function of the voltage to be monitored at a second rate different than said first rate;

wherein said first voltage relative to said second voltage will transition from a more positive voltage to a more negative voltage as said voltage to be monitored varies between a low and a high voltage; and a comparator circuit having a first input coupled to a voltage produced by said first node, and a second input coupled to a voltage produced by said second node to determine when said first and second voltages are within a predetermined separation and polarity.

2. The voltage monitor circuit of claim 1, wherein said first node comprises a junction between a resistor and a device having said first pn junction, and said second node comprises a junction coupling two series-connected resistors together in series with a device having said second pn junction.

3. The voltage monitor circuit of claim 1, wherein said open loop bandgap driver circuit includes a circuit for scaling the voltage to be monitored.

4. The voltage monitor circuit of claim 3, wherein said scaling circuit comprises a respective resistor bridging each said pn junction.

5. The voltage monitor circuit of claim 1, wherein said comparator circuit has no feedback circuit between an output thereof and an input thereof.

6. The voltage monitor circuit of claim 1, wherein said open loop bandgap driver circuit includes a resistor having one terminal connected to the voltage to be monitored, and a second terminal coupled so as to provide current to both pn junctions.

7. The voltage monitor circuit of claim 1, wherein said comparator circuit includes a first comparator having inputs coupled to said open loop bandgap driver circuit, and a second comparator providing a logic output when said first comparator fails to operate properly as a result of an inadequate supply voltage.

8. The voltage monitor circuit of claim 7, wherein said second comparator comprises a single ended amplifier.

9. The voltage monitor circuit of claim 1, further including an enable/disable circuit responsive to a signal for enabling and disabling operation of said open loop bandgap driver circuit.

10. The voltage monitor circuit of claim 9, further including circuits responsive to said signal for driving an output of said voltage monitor circuit to a predefined state.

11. The voltage monitor circuit of claim 10, wherein said circuits drive an output of the voltage monitor circuit to a state indicating that the voltage to be monitored is within a specified limit, when indeed the voltage to be monitored is not within the specified limit.

12. The voltage monitor circuit of claim 1, wherein the voltage to be monitored comprises a supply voltage.

13. The voltage monitor of claim 1, wherein the point at which said first and second voltages are within a predetermined separation and polarity is substantially temperature independent.

14. The voltage monitor of claim 1, wherein said predetermined separation and polarity is substantially zero volts.

15. A voltage monitor circuit, comprising:

a first resistor having a first terminal and a second terminal;

a first pn junction device having a first terminal and a second terminal, the first terminal of said first pn junction device connected in series with the second terminal of said first resistor to define a first node;

a second resistor having a first terminal and a second terminal, a voltage to be monitored being coupled to the first terminals of said first and second resistors;

a third resistor having a first terminal and a second terminal, the first terminal of said third resistor connected to the second terminal of said second resistor to define a second node;

a second pn junction device having a first terminal and a second terminal, the first terminal of said second pn junction device connected to the second terminal of said third resistor;

the second terminals of said first and second pn junction devices connected to a common potential;

the voltage on said first node varying as a function of the voltage to be monitored at a first rate, and the voltage on said second node varying as a function of the voltage to be monitored at a second rate different than said first rate; and a comparator circuit having a first input coupled to the first node, and said comparator circuit having a second input coupled to the second node, and an output of said comparator circuit providing an output of said voltage monitor circuit.

16. The voltage monitor circuit of claim 15, further including a respective resistor bridging each of said pn junction devices.

17. A method of monitoring a voltage, comprising the steps of:

applying a voltage to be monitored as a supply voltage to an open loop bandgap detection circuit;

generating by the open loop bandgap detection circuit a first voltage associated with current driven through a first nonlinear device and a second voltage associated with current driven through a second nonlinear device that each vary with the voltage to be monitored at different rates relative thereto; and comparing with a comparator circuit the first voltage with the second voltage, and providing an output indicating a condition of the voltage to be monitored.

18. The method of claim 17, further including carrying out the comparing step using a comparator without feedback coupled between an input and output of the comparator.

19. The method of claim 17, further including determining whether the voltage to be monitored is above a given threshold.

20. The method of claim 17, wherein the first and second nonlinear devices each have associated therewith a semiconductor junction.

21. The method of claim 17, wherein the condition of the voltage to be monitored is where the difference between the first and second voltages is substantially temperature independent.

* * * * *